US006189708B1

(12) United States Patent
McNeece

(10) Patent No.: US 6,189,708 B1
(45) Date of Patent: Feb. 20, 2001

(54) OVER-DOOR HANGER ROD

(76) Inventor: James R. McNeece, 4832 King Solomon Dr., Annandale, VA (US) 22003

( * ) Notice: Under 35 U.S.C. 154(b), the term of this patent shall be extended for 0 days.

(21) Appl. No.: 09/416,889

(22) Filed: Oct. 13, 1999

(51) Int. Cl.[7] ..... A47H 1/02
(52) U.S. Cl. ..... 211/105.1
(58) Field of Search ..... 211/105.1, 123, 211/113, 16, 87.01, 88.04, 105.2

(56) References Cited

U.S. PATENT DOCUMENTS

| | | | | |
|---|---|---|---|---|
| D. 165,553 | | 12/1951 | Schoor . | |
| 571,184 | | 11/1896 | Bamford . | |
| 872,689 | | 12/1907 | Sarkisian . | |
| 1,325,472 | * | 12/1919 | Ide | 211/123 |
| 1,909,334 | | 5/1933 | Brewer et al. . | |
| 2,584,644 | * | 2/1952 | Verdi | 211/105.1 |
| 2,867,918 | * | 1/1959 | Miller | 211/123 |
| 3,145,849 | * | 8/1964 | Hanson | 211/105.1 |
| 3,174,628 | * | 3/1965 | Kirch, Jr. | 211/123 |
| 3,272,469 | * | 9/1966 | Doty | 211/105.1 |
| 4,529,191 | * | 7/1985 | Miller et al. | 211/123 |
| 4,609,173 | * | 9/1986 | Belokin | 211/105.1 |
| 4,828,122 | | 5/1989 | Day . | |

FOREIGN PATENT DOCUMENTS

| | | |
|---|---|---|
| 282 994 | 9/1952 | (CH) . |
| 460 095 | 5/1928 | (DE) . |
| 954 738 | 10/1947 | (FR) . |
| 128 320 | 5/1949 | (SE) . |

* cited by examiner

*Primary Examiner*—Alvin Chin-Shue
*Assistant Examiner*—Sarah Purol
(74) *Attorney, Agent, or Firm*—Oliff & Berridge, PLC

(57) ABSTRACT

An article suspending device is mounted above a doorway or other wall opening, and suspends hangers, articles of clothing and/or the like in the doorway. The article suspending device includes an article suspending portion that lies in a first plane, at least one stand-off portion connected to the article suspending portion, and at least one mounting leg connected to the at least one stand-off portion. The at least one mounting leg extends in a direction skew to a longitudinal axis of the article suspending portion and lies in a second plane that is perpendicular to the first plane. The article suspending device may also be attached to an exposed overhead floor joist in an unfinished basement or the like, or to an exposed rafter in an unfinished attic or the like.

22 Claims, 5 Drawing Sheets

OVER-DOOR HANGER ROD

BACKGROUND OF THE INVENTION

1. Field of Invention

This invention relates to a device that suspends articles in a wall opening such as a door or a window, and which may also be used to suspend articles from open floor joists, such as are present in an unfinished basement or the like, or from open rafters, such as are present in an unfinished attic or the like.

2. Description of Related Art

It is often necessary or desirable to hang articles, such as clothing, towels or the like, in an opening such as a window or doorway. In particular, after laundering such articles, it is often necessary or desirable to suspend them for a period of time to dry. An opening such as a doorway or window is an ideal place to hang articles for drying because, in general, there is a relatively high airflow through such openings, and the suspended, wet articles will not contact a wall surface and cause moisture damage to the wall surface.

Doorways and windows are typically surrounded by a decorative trim, or molding. The top trim member across a doorway or window is sometimes used to suspend hangers holding clothing articles or the like. However, this arrangement is unstable, and the hangers can easily become dislodged.

SUMMARY OF THE INVENTION

It would be advantageous to provide a device that stably suspends articles in an opening such as a doorway or a window.

In one aspect, this invention provides an article suspending device that suspends an article, such as a clothing article or the like, in an opening in a wall such as a doorway or the like. The article suspending device includes an article suspending portion that lies in a first plane, at least one stand-off portion connected to the article suspending portion and having at least a section that extends away from one side of the first plane, and at least one mounting leg having a connection end that is connected to the at least one stand-off portion. The at least one mounting leg extends in a direction skew to a longitudinal axis of the article suspending portion and lies in a second plane that is perpendicular to the first plane. The at least one mounting leg has a shape such that a fastener can protrude from the at least one mounting leg directly into the wall. The at least one stand-off portion does not extend in a direction away from the other side the first plane, and the connection end of the at least one mounting leg is spaced from the first plane by at least a distance equal to a width of a trim member that is typically mounted over a doorway or other wall opening.

In another aspect, this invention provides an article suspending device that includes a tubular article suspending portion that lies in a first plane, at least one tubular stand-off portion connected to the article suspending portion and having at least a section that extends away from one side of the first plane, and at least one tubular mounting leg having a connection end that is connected to the at least one stand-off portion. The at least one mounting leg extends in a direction skew to a longitudinal axis of the tubular article suspending portion and lies in a second plane that is perpendicular to the first plane. The at least one tubular stand-off portion does not extend in a direction away from another side of the first plane.

In yet another aspect, this invention provides a method of providing an article suspending device above an opening in a wall. The method includes providing an article suspending device that has an article suspending portion that lies in a first plane, at least one stand-off portion connected to the article suspending portion and having at least a section that extends away from one side of the first plane, and at least one mounting leg that extends in a direction skew to a longitudinal axis of the article suspending portion and lies in a second plane that is perpendicular to the first plane. The method further includes mounting the article suspending device on the wall above the opening such that the at least one mounting leg extends in an upward direction and the hanger holding portion is spaced from the wall and substantially horizontal. The method may further include hanging a hanger on the article suspending member.

These and other features and advantages of this invention are described in or are apparent from the following detailed description of exemplary embodiments.

BRIEF DESCRIPTION OF THE DRAWINGS

Exemplary embodiments of this invention will be described in detail, with reference to the following figures, in which.

DETAILED DESCRIPTION OF PREFERRED EMBODIMENTS

This invention provides devices and methods for suspending articles, such as clothing or the like, in a wall opening such as a doorway or a window.

Figure 1:
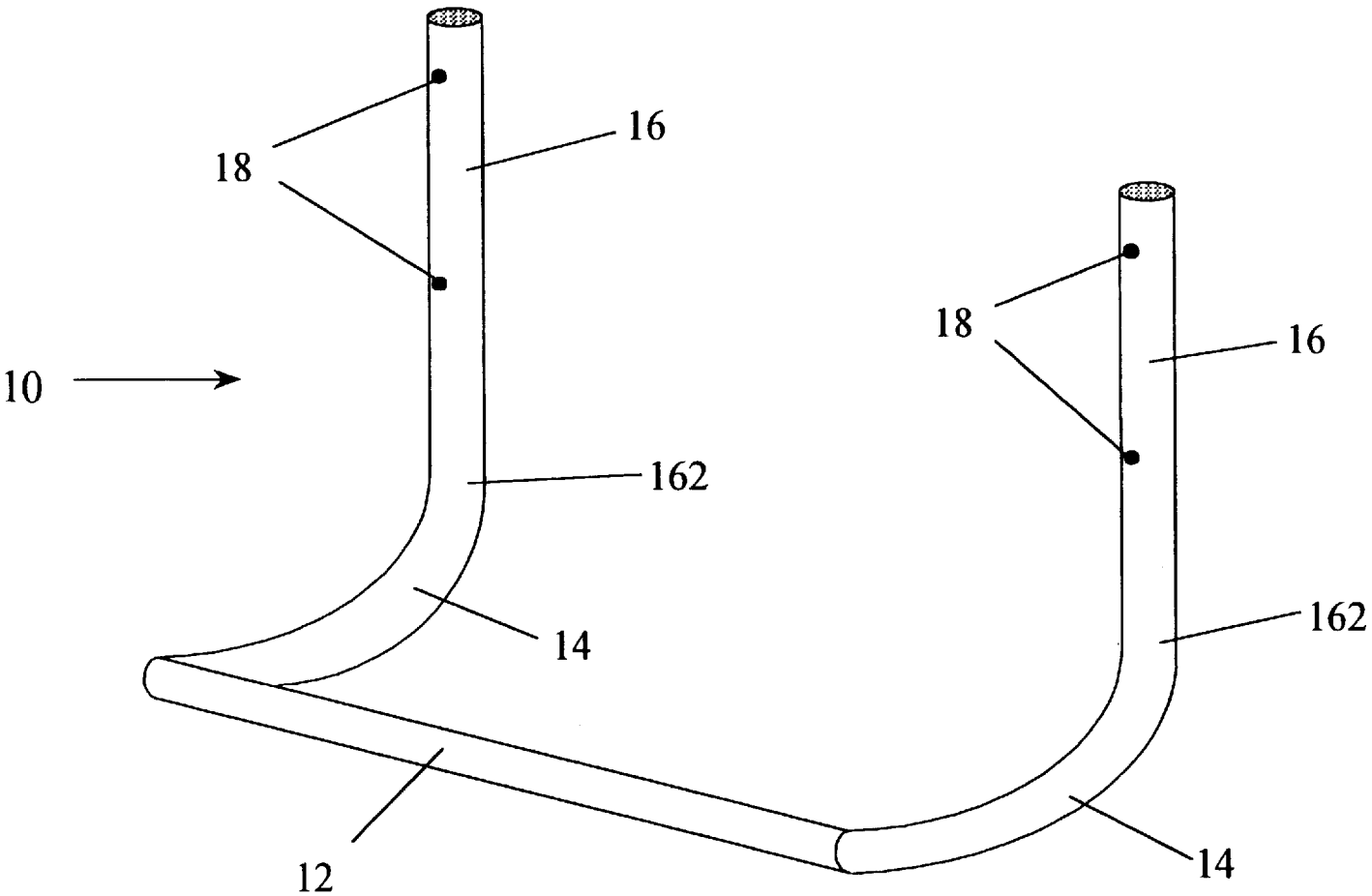
FIG. 1 shows a perspective view of an article suspending device according to one exemplary embodiment of this invention.

FIG. 1 shows a perspective view of an article suspending device 10 according to one exemplary embodiment of this invention. The article suspending device includes an article suspending portion 12, two stand-off portions 14 connected to respective ends of the article suspending portion 12, and two mounting legs 16 connected respectively to the two stand-off portions 14. Fastener holes 18 may be provided in the mounting legs 16.

The mounting legs 16 lie in the same plane, and are each oriented in a direction that is skew to the article suspending portion 12. Each mounting leg 16 has a connection end 162 that is connected to one end of a respective stand-off portion 14.

The article suspending portion 12, the stand-off portions 14 and the mounting legs 16 may be formed integrally with each other, or may be formed separately and then attached together. In some embodiments, a tubular member is used to form the article suspending portion 12, the stand-off portions 14 and/or the mounting legs 16. Using a tubular member, especially a round tubular member, has an advantage in that a single tubular member may be easily bent in any direction to allow formation of the various parts of the article suspending device 10, and has equal strength about any lateral axis.

Figure 2:
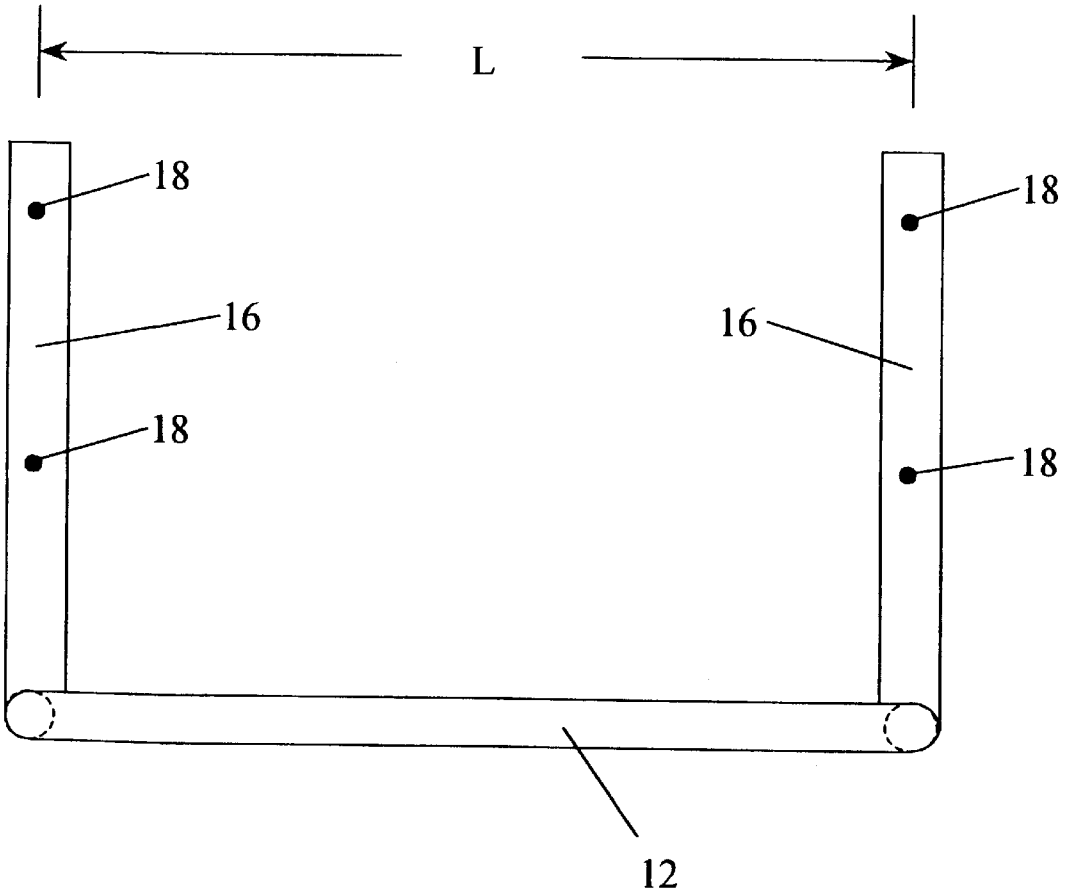
FIG. 2 is a front view of the article suspending device shown in FIG. 1.

FIG. 2 is a front view of the article suspending device 10. The mounting legs 16 in this embodiment are substantially parallel as seen from the front view. However, as long as the mounting legs 16 lie in the same plane, they do not necessarily have to be parallel to each other. A length L of the article suspending portion 12 is preferably, but not essentially, in a range of about 16" to about 36". This is because it is preferable for the article suspending portion 12 to have a length less than or equal to a typical door width, as will be described in greater detail below. Furthermore, framing stud spacing for walls is typically 16" or 24" or some integer multiple thereof. Therefore, providing an article suspending device 10 with mounting legs 16 spaced 16" or 24" may allow a user to attach the article suspending device 10 to the studs of a wall for greater strength.

However, conventional dry-wall anchors (not shown) or the like may also be used to attach the article suspending device 10 to a wall. In this case, the length L of the article suspending portion 12 may be any desired length, including lengths less than 16" or greater than 36". It should be appreciated, however, that, when the article suspending portion 12 is loaded with a given load, the amount of deflection of the article suspending portion 12 will be proportional to the length of the article suspending portion 12. Therefore, it is preferable to avoid making the article suspending portion 12 excessively or unnecessarily long, e.g., longer than the width of a door over which it will be mounted. If, for example, the article suspending device 10 is to be mass-produced at a single length, an article suspending portion 12 of about 24" is particularly advantageous because 24" is less than or equal to most typical door widths, yet long enough to suspend a relatively large number of articles.

Figure 3:
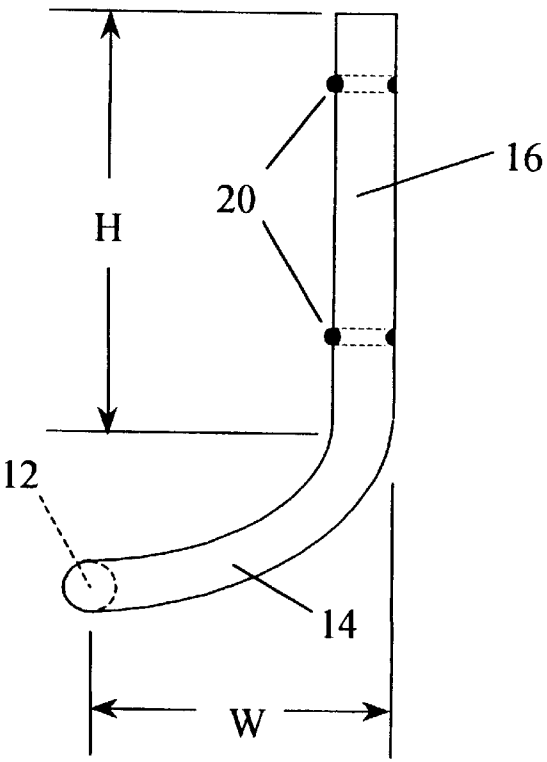
FIG. 3 is a side view of the article suspending device shown in FIG. 1.

FIG. 3 is a side view of the article suspending device 10. "H" designates a length, or, more precisely, a vertical component of the length, of the mounting legs 16. "W" designates a distance from a plane tangent to the back sides of the mounting legs 16 to a longitudinal axis of the article suspending portion 12. The ratio of H to W is preferably in a range of about 2.5:1 to about 1.5:1, and more preferably about 1.7:1. For example, H may be about 6", and W may be about 3.5". Fasteners 20 may be used to attach the article suspending device 10 to a wall. The fasteners 20 may be screws or nails, for example, that pass through the fastener holes 18 (FIG. 1).

The ratio of H to W is important because of the moment, or torque, that is created about the connections ends 162 of the mounting legs 16 when articles are suspended from the article suspending portion 12. For example, it is possible to hang many clothes hangers holding clothing articles from the article suspending portion. However, this results in a comparatively large weight on the article suspending portion 12. If the H to W ratio is not sufficiently large, an excessive axial load, or pull-out force, will be exerted on the fasteners 20, in particular, the top fasteners 20, that pass through the fastener holes 18. At the same time, if H is excessively large, the article suspending device 10 will not fit in the space between the top of a wall opening, such as a door, and the ceiling of a room when the article suspending device 10 is mounted as described below.

In the above description, "H" is defined as the vertical component of the length of the mounting legs 16. Those skilled in the art will appreciate that, in reality, the critical distance in terms of the pull-out force is the vertical component of the distance from a connection end 162 of mounting legs 16, or the lowermost point at which the mounting leg 16 contacts the wall, to the point at which a top fastener 20 passes through the mounting leg 16, i.e., the top fastener hole 18. However, the vertical component of the length of the mounting legs 16 establishes the theoretical maximum distance from the connection end 162 to the top fastener hole 18, and therefore is used as the length H in the above discussion of the H to W ratio.

Figure 4:
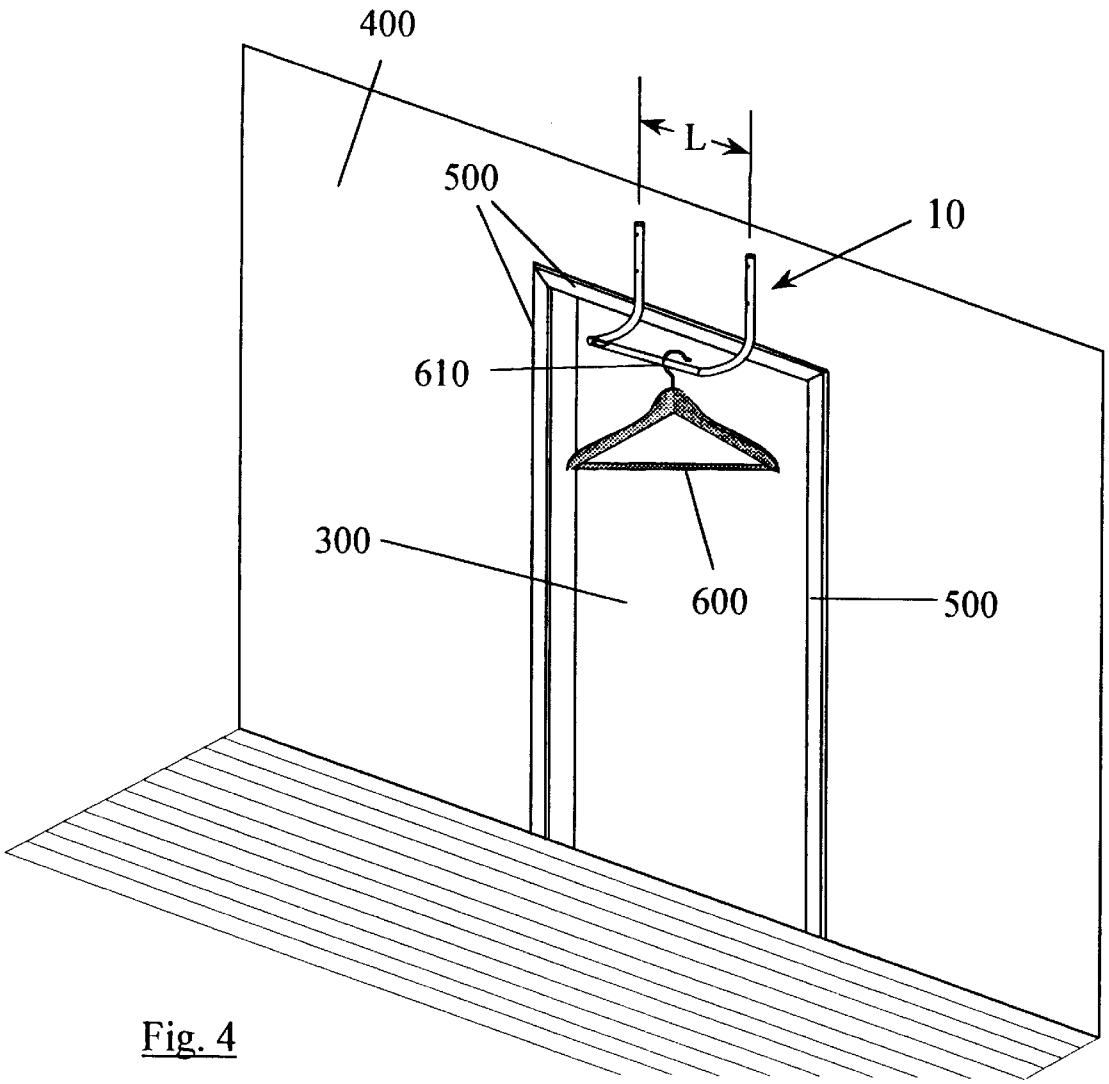
FIG. 4 is a perspective view of an exemplary mounting configuration of the article suspending device shown in FIG. 1.

FIG. 4 is a perspective view of an exemplary mounting configuration of the article suspending device 10. Specifically, in FIG. 4, the article suspending device 10 is mounted on a wall 400 above a doorway 300. The doorway 300 may be trimmed by trim members 500 that are attached to the wall 400 at the top and sides of the doorway 300. In other mounting configurations, a doorway or other wall opening above which the article suspending device 10 is mounted may not be trimmed.

A hanger 600 having a hook 610 may be suspended from the article suspending portion 12 of the article suspending device 10. Clothing or other articles may be suspended from the hanger 600. Alternatively, articles may be draped over and suspended directly from the article suspending portion 12.

A preferred length of the article suspending portion 12 of the article suspending device 10 will now be described in greater detail. The article suspending portion 12 preferably has a length less than or equal to the width of the doorway 300. One reason for this is that, in order to fit many hangers 600 on the article suspending portion 12, the hangers 600 are preferably hung in planes that are substantially perpendicular to the plane of the wall 400. Therefore, hangers will only fit on portions of the article suspending portion that are directly above the doorway 300, so there is little point in having the article suspending portion 12 extend beyond the doorway on either side.

Additionally, as stated above, an excessively or unnecessarily long article suspending portion 12 will deflect more when loaded with a given load, which is unsightly and decreases the maximum load that can be applied before the article suspending portion plastically deforms or is broken.

Furthermore, problems may arise if a hanger holding an article is suspended from the article suspending portion 12 that is longer than the width of the doorway 300. For example, if the article is slid to one side or the other of the doorway 300, the hook 610 of the hanger 600 will slide past the side of the doorway 300, but part of the hanger 600 will contact and be stopped by the side of the doorway 300. Therefore, the hanger 600 will tend to rotate out of a plane that is perpendicular to the wall 400. This may result in the hanger 600 falling off of the article suspending portion 12, and/or may cause annoyance or even injury to the user if he or she is positioned such that the rotating hanger comes into contact with his or her face, for example.

Nonetheless, even though the length L of the article suspending portion 12 is preferably less than or equal to the width of the doorway 300, some embodiments of this invention may include an article suspending portion 12 with a length L that is greater than the width of the doorway 300.

Figure 5:
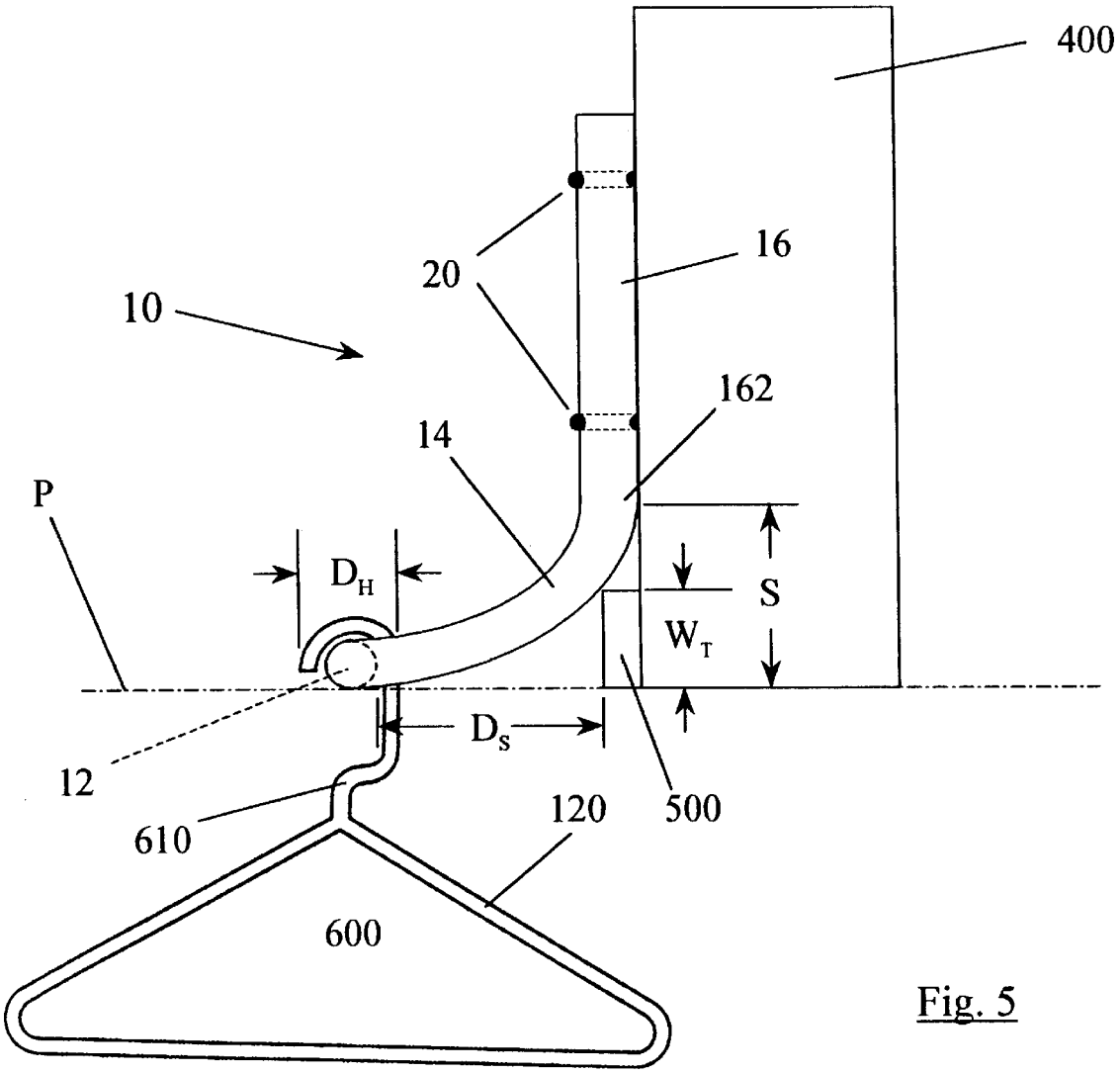
FIG. 5 is an enlarged side view of the exemplary mounting configuration of the article suspending device shown in FIG. 4.

FIG. 5 is an enlarged side view of the exemplary mounting configuration of the article suspending device 10 shown in FIG. 4. As shown in FIG. 5, the lowest part of the article suspending portion 12 is at the same elevation as a plane P that extends from the top of the doorway 300 (FIG. 4). The lowest part of the article suspending portion 12 may also be somewhat higher than the plane P, provided that an extension portion 620 of the hanger 600 does not contact the wall 400 or the trim 500 when the hanger 600 is freely suspended from the article suspending portion 12.

Fasteners 20 pass through the fastener holes 18 of the mounting legs 16, and engage with the wall 400. If the wall is lined with drywall sheeting, the fasteners preferably engage either a stud (not shown) in the wall 400 or a conventional drywall anchor (not shown) provided in the wall 400.

Furthermore, each stand-off portion 14 extends from the article suspending portion 12 to a respective mounting leg 16. At least one section of each stand-off portion 14 extends away from the plane P, and no part of the stand-off portions extends below the plane P. Therefore, no part of the article suspending device projects into the doorway 300. This is advantageous both from a safety standpoint and an aesthetic standpoint. Specifically, since no part of the article suspending device projects into the doorway 300, a user may freely walk through the doorway 300 without the potential of striking his or her head on the article suspending device 10. Furthermore, the article suspending device 10 can be mounted above the doorway on one side of the wall 400 such that it is unobtrusive when looking through the doorway from the other side of the wall 400.

In this embodiment, the stand-off portions 14 are curved. This results in gradual transitions that facilitate manufacturing the stand-off portions 14 and the mounting legs 16 from a single member by bending the member into the appropriate shape, for example. Furthermore, in FIG. 1, the transitions between the stand-off portions 14 and the article suspending portion 12 are substantially square, but these transitions may also be curved, thereby further facilitating manufacture of the entire article suspending device 10 from a single member by bending.

When the article suspending device 10 is mounted as shown in FIG. 5, a distance S between the connection end 162 of each mounting leg and the plane P, which corresponds to the elevation of the top of the doorway 300, is greater than a width $W_T$ of the trim 500. This allows the article suspending device 10 to be mounted so that the lowest part of the article suspending portion 12 is at the same elevation as the plane P, but without the trim 500 interfering with the mounting legs 16. The width $W_T$ may, for example, be in a range of from about 0.75" to about 3". A trim with a width $W_T$ of about 2" is particularly common.

In some embodiments, rather than being greater than the width $W_T$ of the trim 500, the distance S may be equal to width $W_T$.

The minimum distance $D_S$ between the trim 500 and the article suspending portion 12 is, in this embodiment, greater than the maximum horizontal distance $D_H$ across a hook 610 of the hanger 600. This allows the hanger 600 to be hung by inserting the hook 610 between the wall 400 and the article suspending portion 12, and then suspending the hook 610 from the article suspending portion 12. Preferably, the distance $D_s$ is about 1.5 to about 2.0 times larger than the distance $D_H$. A typical hanger hook has a distance $D_H$ of from about 2" to about 2.5". Therefore, the distance $D_s$ is preferably in a range of from about 3" to about 5".

Figure 6:
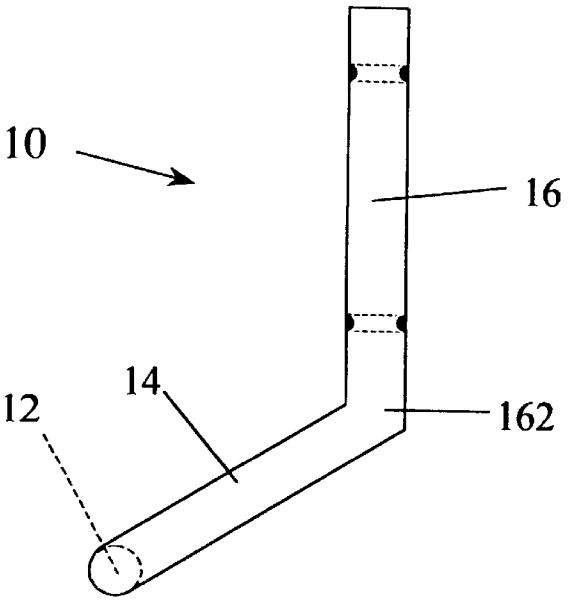
FIG. 6 is a side view of another exemplary embodiment of this invention.

FIG. 6 is a side view of another exemplary embodiment of this invention. In this embodiment, rather than being curved, the stand-off portions 14 are straight and angled downward. As in the first embodiment, the stand-off portions 14 have at least one section that extends away from a plane in which the article suspending portion 12 lies, and which is perpendicular to a plane in which the mounting legs 16 lie. Therefore, as in the first embodiment, the article suspending device 10 may be mounted over a doorway with a trim member, without interfering with the trim member.

Figure 7:
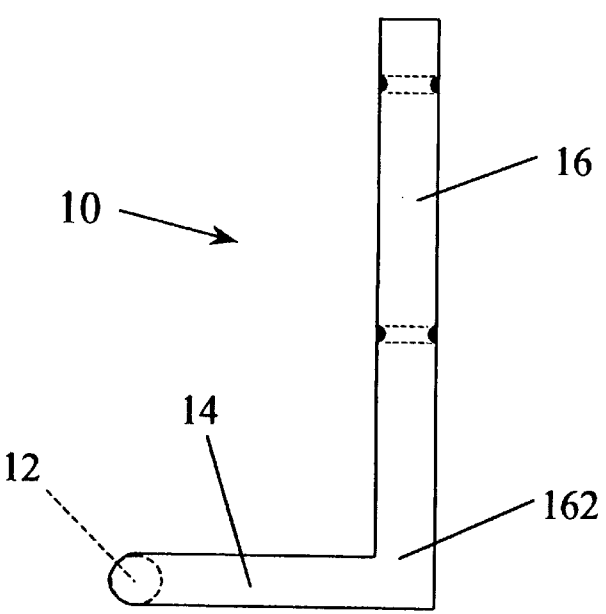
FIG. 7 is a side view of yet another exemplary embodiment of this invention.

FIG. 7 is a side view of yet another exemplary embodiment of this invention. In this embodiment, the stand-off portions 14 are straight and are substantially perpendicular to a plane in which the mounting legs 16 lie. This embodiment has an advantage in that the mounting legs 16 may be made longer, thus decreasing the moment that is created about the connection ends 162. However, the connection ends 162 are not spaced from the plane in which the article suspending portion 12 lies and which is perpendicular to the plane in which the mounting legs lie. Therefore, if the article suspending device 10 is mounted on a doorway surrounded by trim, the article suspending portion cannot be mounted even with the top of the doorway without the mounting legs 16 interfering with the trim. However, this embodiment is suitable, for example, for use above doorways not surrounded by trim, or if the width of the trim is small enough that, even though the article suspending device 10 is mounted above the trim, the article suspending portion 12 is low enough that a hanger may be suspended from the article suspending portion without contacting the trim or wall above the doorway.

While the invention has been described in conjunction with the specific embodiments described above, many equivalent alternatives, modifications and variations will become apparent to those skilled in the art once given this disclosure. Accordingly, the preferred embodiments of the invention as set forth above are considered to be illustrative and not limiting. Various changes to the described embodiments may be made without departing from the spirit and scope of the invention.

For example, although the illustrated embodiments have two mounting legs and two corresponding stand-off portions, it is also possible to provide only one mounting leg and one stand-off portion. In this case, the stand-off portion would preferably be connected at or near a longitudinal center of the article suspending portion. Furthermore, it is also possible to provide more than two mounting legs and corresponding stand-off portions for greater rigidity and stability.

Additionally, although the illustrated embodiments have been described in the context of being mounted above a wall opening, other mounting locations are also possible. For example, the article suspending device may be attached to an exposed overhead floor joist in an unfinished basement or the like, or to an exposed rafter in an unfinished attic or the like.

What is claimed is:

1. An article suspending device that suspends an article in an opening in a wall having a trim member on the wall at least at a top of the opening, comprising:

an article suspending portion, the article suspending portion lying in a first plane;

at least one stand-off portion connected to the article suspending portion and having at least a section that extends away from one side of the first plane; and at least one mounting leg having a connection end that is connected to the at least one stand-off portion, the at least one mounting leg extending in a direction skew to a longitudinal axis of the article suspending portion and lying in a second plane that is perpendicular to the first plane, the at least one mounting leg having at least one opening through which a fastener protrudes from the least one mounting leg directly into the wall; wherein the at least one stand-off portion does not extend in a direction away from another side of the first plane;

the connection end of the at least one mounting leg is spaced from the first plane by at least a distance equal to a width of the trim member; and the article suspending portion, the at least one stand-off portion and the at least one mounting leg are unitary.

2. The article suspending device as set forth in claim 1, wherein the width of the trim member is in a range of from about 0.75" to about 3".

3. The article suspending device as set forth in claim 1, wherein the width of the trim member is about 2".

4. The article suspending device as set forth in claim 1, wherein the article suspending portion is spaced from the second plane by a distance of from about 3" to about 5".

5. The article suspending device as set forth in claim 1, wherein the article suspending portion is spaced from the second plane by a distance of about 3.5".

6. The article suspending device as set forth in claim 1, wherein the article suspending portion, the at least one stand-off portion and the at least one mounting leg are formed from a tubular member.

7. The article suspending device as set forth in claim 1, wherein a ratio of a length of the at least one mounting leg to a length of the at least one stand-off portion is in a range of from about 2.5:1 to about 1.5:1.

8. The article suspending device as set forth in claim 1, wherein a ratio of a length of the at least one mounting leg to a length of the at least one stand-off portion is about 1.7:1.

9. The article suspending device as set forth in claim 1, wherein the section of the at least one stand-off portion that extends away from one side of the first plane is curved.

10. The article suspending device as set forth in claim 1, wherein the section of the at least one stand-off portion that extends away from one side of the first plane is straight.

11. The article suspending device as set forth in claim 1, wherein a length of the article suspending portion is less than or equal to a width of the opening.

12. The article suspending device as set forth in claim 1, wherein a length of the article suspending portion is in a range from about 24" to about 36".

13. The article suspending device as set forth in claim 1, wherein a length of the article suspending portion is about 24".

14. An article suspending device that suspends an article, comprising:

a tubular article suspending portion, the article suspending portion lying in a first plane;

at least one tubular stand-off portion connected to the article suspending portion and having at least a section that extends away from one side of the first plane; and at least one tubular mounting leg having a connection end that is connected to the at least one stand-off portion, the at least one mounting leg extending in a direction skew to a longitudinal axis of the tubular article suspending portion and lying in a second plane that is perpendicular to the first plane; wherein the at least one tubular stand-off portion does not extend in a direction away from another side the first plane; and the article suspending portion, the at least one stand-off portion and the at least one mounting leg are unitary.

15. The article suspending device as set forth in claim 14, wherein the article suspending portion is spaced from the second plane by a distance of from about 3" to about 5".

16. The article suspending device as set forth in claim 14, wherein the article suspending portion is spaced from the second plane by a distance of about 3.5".

17. The article suspending device as set forth in claim 14, wherein a length of the article suspending portion is less than or equal to a width of a wall opening, and the article suspending portion suspends an article in the wall opening.

18. The article suspending device as set forth in claim 14, wherein a length of the article suspending portion is in a range from about 16" to about 36".

19. The article suspending device as set forth in claim 14, wherein a length of the article suspending portion is about 24".

20. A method of providing an article suspending device above an opening in a wall, comprising:

providing a unitary article suspending device, the unitary article suspending device comprising:

an article suspending portion, the article suspending portion lying in a first plane, at least one stand-off portion connected to the article suspending portion and having at least a section that extends away from one side of the first plane, and at least one mounting leg that extends in a direction skew to a longitudinal axis of the article suspending portion and lying in a second plane that is perpendicular to the first plane; and mounting the unitary article suspending device on the wall above the opening with the at least one mounting leg extending in an upward direction and the hanger holding portion spaced from the wall and substantially horizontal.

21. The method as set forth in claim 20, further comprising hanging a hanger on the article suspending member.

22. The method as set forth in claim 21, wherein, when the hanger is freely suspended from the article suspending member, the hanger lies in a plane that is substantially perpendicular to the wall.

* * * * *